US008056194B2

(12) United States Patent
Miyazaki et al.

(10) Patent No.: US 8,056,194 B2
(45) Date of Patent: Nov. 15, 2011

(54) SLIDER FOR SLIDE FASTENER

(75) Inventors: Yohel Miyazaki, Toyama-Ken (JP); Keiichi Keyaki, Toyama-Ken (JP)

(73) Assignee: YKK Corporation (JP)

( * ) Notice: Subject to any disclaimer, the term of this patent is extended or adjusted under 35 U.S.C. 154(b) by 691 days.

(21) Appl. No.: 12/168,319

(22) Filed: Jul. 7, 2008

(65) Prior Publication Data

US 2009/0019676 A1 Jan. 22, 2009

(30) Foreign Application Priority Data

Jul. 20, 2007 (JP) ..... 2007-189220

(51) Int. Cl.
*E05D 5/06* (2006.01)

(52) U.S. Cl. ..... 24/389; 24/387; 24/415; 24/427; 24/428; 24/436

(58) Field of Classification Search ..... 24/387, 24/389, 415, 436, 414, 427, 428
See application file for complete search history.

(56) References Cited

U.S. PATENT DOCUMENTS

| | | | | |
|---|---|---|---|---|
| 4,409,705 | A * | 10/1983 | Yuunaga | 24/415 |
| 4,562,622 | A * | 1/1986 | Takabatake | 24/427 |
| 5,297,320 | A * | 3/1994 | Keyaki et al. | 24/430 |
| 6,490,770 | B1 * | 12/2002 | Matsuda et al. | 24/428 |
| 6,530,132 | B2 * | 3/2003 | Yamagishi et al. | 24/427 |
| 7,059,024 | B2 * | 6/2006 | Yoneoka et al. | 24/391 |
| D607,775 | S * | 1/2010 | Miyazaki et al. | D11/221 |
| 7,802,347 | B2 * | 9/2010 | Tachi et al. | 24/427 |
| D627,258 | S * | 11/2010 | Miyazaki et al. | D11/221 |
| 2002/0050030 | A1 * | 5/2002 | Takasawa | 24/415 |
| 2004/0154144 | A1 * | 8/2004 | Yoneoka et al. | 24/391 |
| 2008/0034559 | A1 * | 2/2008 | Tachi et al. | 24/427 |
| 2009/0260197 | A1 * | 10/2009 | Keyaki et al. | 24/415 |

FOREIGN PATENT DOCUMENTS

| | | |
|---|---|---|
| GB | 2077849 A | 12/1981 |
| GB | 2303876 A | 3/1997 |
| JP | 09-037817 | 2/1997 |

OTHER PUBLICATIONS

European Search Report, European Patent Application No. 08252369.7, mailed Dec. 27, 2010.

* cited by examiner

*Primary Examiner* — Robert Sandy
*Assistant Examiner* — Tyler Johnson
(74) *Attorney, Agent, or Firm* — Kilpatrick Townsend & Stockton LLP

(57) ABSTRACT

The present invention provides a slider wherein a Y-shaped guide groove which allows a fastener chain to pass therethrough is provided in a body of a slider, the intermediate partition which is raised inward on both sides of a guide post and extends from an inside end of the guide post toward a rear mouth is provided on an inner surface of one of upper and lower blades, and a top surface of the intermediate partition is formed into an entirely inclined slope such that a shoulder mouth side is higher than a rear mouth side, thereby enabling to catch and introduce coupling heads of fastener elements exposed from the side edges of the fastener tapes, so that the coupling heads of the right and left fastener elements are engaged with each other between the guide post and the rear mouth.

7 Claims, 13 Drawing Sheets

SLIDER FOR SLIDE FASTENER

INCORPORATION BY REFERENCE

The present application claims priority under 35 U.S.C. §119 to Japanese Patent Application No. 2007-189220 filed on Jul. 20, 2007. The content of the application is incorporated herein by reference in its entirety.

BACKGROUND OF THE INVENTION

1. Field of the Invention

The present invention relates to a slider of a linear slide fastener, and more specifically, to a slider for a slide fastener which is applicable to a fastener chain in which linear fastener elements formed into a coil shape or zigzag shape are attached to one side edge of a fastener tape, particularly, a flat thin linear slide fastener chain having no core thread, in which fastener elements are knitted or woven so that a coupling head side of the fastener elements is exposed from a fastener tape.

2. Description of the Related Art

There is conventionally known a slide fastener slider, as shown in FIG. 17, having the following configuration. Raised portions 111 which are raised in a fixed height from an upper blade 104 are provided on proximal portions on both sides of a guide post 106 of an inner surface of the upper blade 104 of a slider body. A front end portion whose tip is pointed toward a rear mouth side 114 is provided so as to be continuous from the raised portions 111. A wedge-shaped projection is provided to connect the front end portion with the raised portion 111, so that an intermediate partition is formed of the raised portion 111, the wedge-shaped projection and the front end portion and the edge portions of these components of the intermediate partition are formed into a square shape. Consequently, a coupling head of the fastener element can be caught and introduced from the raised portion 111 to the front end portion.

As a conventionally known slide fastener slider, a slider of type shown in FIG. 18 has been known. An intermediate partition of this slider is formed raised in a fixed height from a lower blade 205 in the center in a longitudinal direction thereof so that the intermediate partition extends from an inside end of the guide post 206 toward a rear mouth of a body 202, while no intermediate partition is provided on proximal portions on both sides of the guide post 206 provided on the body.

Patent document 1: Japanese Patent Application Laid-Open No. 9-37817

In the slider shown in FIG. 17, the intermediate partition provided on the inner surface of the upper blade 104 such that the intermediate partition extends from both sides of the guide post 106 to the rear mouth side is projected in a fixed height from the inner surface of the upper blade 104. Further, the edges of the intermediate partition including the raised portion 111, the wedge-shaped projection and the front end portion are formed into a square shape. Consequently, when the slider is slid along the fastener elements, frictional resistance between the upper blade 104 and the fastener chain is increased if the intermediate partition is formed high, and the fastener elements fall in so that the engagement motion sometimes becomes unstable if it is formed low. Further, because the edge of the intermediate partition is formed in the square shape, the fastener elements can be damaged by the sliding motion when the slider is slid. Additionally, there is a fear that the sliding operation of the slider cannot be carried out smoothly.

In the slider of the conventionally known slide fastener shown in FIG. 18, the intermediate partition provided on the lower blade 205 of the slider body is extended from the inside end of the guide post 206 toward the rear mouth. Thus, no intermediate partition exists on both sides of the guide post 206. When a fastener stringer 224 is inserted into a guide groove 208 of the slider of this type from the shoulder mouth of the body, coupling heads to which right and left fastener stringers 224 are coupled are placed on the surface of the intermediate partition on the rear mouth side of the body. With this configuration, even if a tension in the lateral direction is applied to the fastener chain to some extent, a stable coupling condition can be maintained.

However, if a lateral pulling load, that is, a tension in the direction of an indicated arrow is applied to the fastener stringer 224 on both sides of the guide post 206, the coupling head of the fastener element 223 is brought into pressure contact with the lower blade 205 of the body because no intermediate partition is provided. In addition, with a connecting portion, at which the fastener elements 223 are inverted, brought into pressure contact with the corner portion on the flange 207 side of the upper blade 204, the fastener elements 223 are arranged in an inclined state to the slider. Consequently, it becomes very hard to slide the fastener stringer 224 and the sliding resistance when the slider is slid is increased, and further the fastener elements 223 can damage the coupling heads due to the sliding contact with the slider. Particularly as the lateral pulling load is applied more strongly to flat thin fastener elements 223 of knitted type or woven type in which no core thread exists within the fastener elements 223, the fastener stringers 224 tend to bite each other with the fastener elements 223 inclined.

SUMMARY OF THE INVENTION

The present invention has been achieved in views of the above-described problems, and a first object of the present invention is to provide a slider for a slide fastener in which a surface of an intermediate partition provided on an inner surface of one blade of upper and lower blades provided around a guide post in a Y-shaped guide groove in which fastener chains are passed through, namely, a top surface of the intermediate partition is formed into a slope which rises as it goes from a rear mouth side toward a shoulder mouth side of the slider, so that when the fastener chains are passed through the slider, coupling heads of fastener elements are prevented from dropping to a fastener tape more than required, that is, fastener stringers located sideway of the guide post are prevented from being inclined within the guide groove of the body even if the slider is slid with a tension in a lateral direction applied to the fastener chains, whereby the slider can be accurately and smoothly slid.

A second object of the present invention is to provide a slider for a slide fastener of the first object, wherein the upper blade having an attaching portion to which a pull tab is to be attached and an opposing lower blade are connected through a guide post, wherein the intermediate partition presenting a slope configuration formed within the guide groove is provided on the inner surface of the blade of the body opposing the back side surface of the fastener tape in the fastener chain to which the fastener elements are attached so as to introduce the fastener chains smoothly and allow the fastener chains to be coupled to each other on the surface of the intermediate surface provided between the guide post and the rear mouth.

A third object of the present invention is to provide a slider for a slide fastener of the first object, wherein the intermediate partition to be provided on the body of the slider is formed from the rear mouth side of the body to proximal portions sideway of the guide post so as to accurately and smoothly guide the fastener elements attached to one side edge of the fastener tape.

A fourth object of the present invention is to provide a slider for a slide fastener of the first object, wherein the intermediate partition to be provided on both sides of the guide post in the body of the slider is formed of a raised portion in a narrow width, and the raised portion is disposed in the same direction as a direction in which the slider is slid on the fastener chain, so as to smoothly guide the coupling heads of the fastener elements in the fastener stringer from the shoulder mouth in the body of the slider into the guide groove.

A fifth object of the present invention is to provide a slider for a slide fastener of the first object, wherein the intermediate partition to be provided sideway of the guide post in the body of the slider has a top surface having a fixed width, and the front surface and the side surface of the top surface are formed of a smooth face presenting a slope with respect to the inner surface of the blade, so as to smoothly guide the fastener elements attached to one side edge of the fastener stringer.

A sixth object of the present invention is to provide a slider for a slide fastener of the first object, wherein a parallel portion in a narrow width is extendedly provided at the front end on the rear mouth side of the intermediate partition in the body of the slider, so as to securely discharge coupled portions of the right and left fastener elements out of the body and introduce the right and left fastener elements from out of the body.

A seventh object of the present invention is to provide a slider for a slide fastener of the first object, wherein the intermediate partition in the body of the slider is provided continuously such that the width thereof is increased gradually toward the raised portions provided within the guide groove, so as to smoothly and easily guide the coupling heads of the fastener elements of the fastener chain within the guide groove.

To achieve the above-described object, according to a first aspect of the present invention, there is provided a slider for a slide fastener in which a pair of upper and lower blades opposing each other are connected through a guide post while a Y-shaped guide groove which allows a fastener chain to pass therethrough is provided between the pair of blades, wherein the intermediate partition is provided on an inner surface of one of the blades in the body of the slider so that the intermediate partition projects toward the other one of the blades and an amount of projection inward of the guide groove is larger on a side of a shoulder mouth than a side of a rear mouth, and a surface, namely, a top surface of the intermediate partition is formed into a slope which rises as it goes from a rear mouth side to a shoulder mouth side. Particularly, the slider for a slide fastener has a structure suitable for a fastener chain in which linear fastener elements are knitted or woven directly into one side edge of a fastener tape.

According to a second aspect of the present invention, there is provided a slider for a slide fastener of the first aspect, wherein the body is constituted of an upper blade having a pull tab attaching portion on a surface of the slider and a lower blade located at a position opposing the upper blade and connected thereto through a guide post, and the intermediate partition portion is formed on one of the blades opposing a surface opposite to a surface of the fastener chain to which the fastener elements are attached.

According to a third aspect of the present invention, there is provided a slider for a slide fastener of the first aspect, wherein the intermediate partition to be provided within the guide groove of the body of the slider is formed from the rear mouth of the body toward proximal portions on both sides of the guide post. The both sides of the guide post refer to side surfaces extending substantially in parallel to a direction in which the slider slides with respect to the fastener tape.

According to a fourth aspect of the present invention, there is provided the slider for a slide fastener of the first aspect, wherein the intermediate partition formed on both sides of the guide post of the body of the slider is formed of a raised portion in a narrow width, and the raised portion is disposed in a same direction as a sliding direction of the slider.

According to a fifth aspect of the present invention, there is provided the slider for a slide fastener of the first aspect, wherein the intermediate partition provided on the sides of the guide post of the body of the slider has a top surface having a fixed width, and a front surface and a side surface of the top surface are connected to the inner surface of one of the blades through a slope.

According to a sixth aspect of the present invention, there is provided the slider for a slide fastener of the first aspect, wherein the intermediate partition to be provided within the guide groove of the body of the slider is provided with a parallel portion whose both sides are parallel and which is formed in a narrow width and extended from the front end of the intermediate partition on the rear mouth side, and the parallel portion is formed in a fixed height with respect to the one of the blades.

According to a seventh aspect of the present invention, there is provided the slider for a slide fastener of the first aspect, wherein the intermediate partition is provided in the guide groove of the body of the slider such that a width thereof is increased gradually as it goes form the parallel portion toward the raised portion provided sideway of the guide post.

According to the first aspect of the present invention, the following effect is exerted in the slider for a slide fastener in which a pair of blades are connected with a guide post and a guide groove which allows a fastener chain to pass therethrough is provided between the blades, an intermediate partition is provided on an inner surface of one blade in a body of the slider so that the intermediate portion projects to the other blade, and the intermediate partition is formed so that the amount of projection on the shoulder mouth side is larger than that on the rear mouth side while a top surface of the intermediate partition is formed into a slope which rises as it goes toward the shoulder mouth side.

This slider is most suitable for a knitted type or woven type flat thin fastener stringer in which linear fastener elements are attached onto one side edge of a fastener tape while particularly no core thread is passed through an inside of linear fastener elements. The surface of the intermediate partition provided within the guide groove of the body is formed into a slope in which the shoulder mouth side is high while the rear mouth side is low. With this configuration, coupling heads of the flat, thin fastener elements are accurately introduced to the intermediate partition in order to prevent the fastener elements from being inclined in a lateral direction sideways of the guide post or the coupling head of the fastener element from being inclined toward the fastener tape face and dropping thereto by pressing the side edge of the fastener tape. At the same time, the right and left fastener elements can be coupled with each other on the intermediate partition on the low rear mouth side. Consequently, coupling of the fastener stringers can be carried out smoothly and easily.

According to the second aspect of the invention, the slider is constituted of an upper blade having a pull tab attaching portion and a lower blade located at a position opposing the upper blade and connected thereto through a guide post. The slope-like top surface formed on the intermediate partition is provided on the blade opposing a surface opposite to a surface of the fastener tape in the fastener chain to which the fastener elements are attached. Consequently, the intermediate partition having the slope-like top surface provided within the guide groove of the body of the slider is formed on any one of the upper and lower blades which faces the surface opposite to the surface in which the fastener elements are knitted in or woven in, so as to securely introduce the coupling head of the fastener element.

According to the third aspect of the invention, the intermediate partition is formed from the rear mouth of the body toward proximal portions on both sides of the guide post. With this configuration, the fastener elements knitted or woven into one side edge of the fastener tape can be securely and smoothly introduced by the intermediate partition provided within the guide groove in the body.

According to the fourth aspect of the invention, the intermediate partition formed on both sides of the guide post is formed of a raised portion in a narrow width, and the raised portion is disposed in the same direction as the sliding direction of the slider. With this configuration, the intermediate partition provided on both sides of the guide post of the body coincides with a sliding trajectory of the slider, so that the coupling heads of the fastener elements can be guided securely and smoothly.

According to the fifth aspect of the invention, the intermediate partition provided on both sides of the guide post has a top surface having a fixed width and the top surface is connected to the inner surface through a slope, so that the front surface and the side surface continuous to the top surface of the intermediate partition are connected to the inner surface through the slope. Thus, the coupling heads of the fastener elements exposed from the side edge of the fastener tape are prevented from being worn or damaged due to contact with the intermediate partition, whereby the fastener elements are guided smoothly.

According to the sixth aspect of the invention, the intermediate partition is provided with a parallel portion in a narrow width whose sides on both sides are parallel at the front end on the rear mouth side, and the parallel portion is formed in a fixed height with respect to the blade. Therefore, the operations of discharging or inserting the fastener elements through the rear mouth in the body of the slider can be carried out smoothly and easily with the coupling heads of the right and left fastener elements coupled with each other by the parallel portion provided within the guide groove.

According to the seventh aspect of the invention, the intermediate partition is provided such that the width thereof is increased gradually as it goes from the parallel portion toward the raised portion. Thus, the intermediate partition provided within the guide groove is formed such that the width thereof is expanded as it goes from the parallel portion to the raised portion. Thereby, the fastener elements in the fastener chain are engaged and disengaged smoothly and easily. That is, the effects which the present invention exerts are extremely remarkable.

DESCRIPTION OF THE PREFERRED EMBODIMENTS

Figure 1:
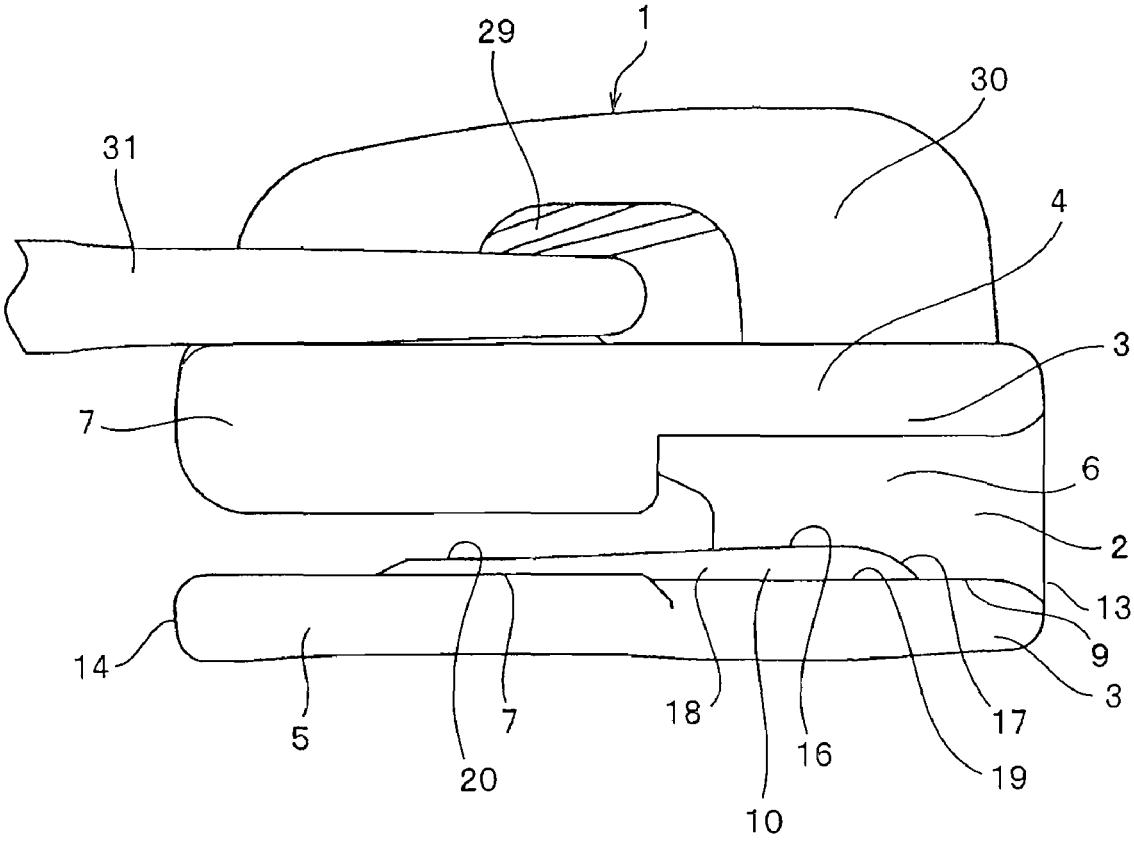
FIG. 1 is a side view of a slider for a slide fastener according to a first embodiment.

A slider for a slide fastener of the present invention is made of metal, and a body 2 thereof is configured such that blades 3 including an upper blade 4 and a lower blade 5 are connected through a guide post 6. The guide post 6 forms a Y-shaped guide groove 8 for guiding fastener elements by bringing right and left shoulder mouths 13 for separating and feeding fastener elements 23 attached to one side edge of each of right and left fastener tapes 22 through a space between the upper and lower blades 3 into communication with a single rear mouth 14 for feeding the fastener elements 23 in a coupling condition. The blade 3 has a flange 7 projecting from each of both side edges, and the flange 7 on one of the upper and lower blades 3 is formed higher than the other flange 7. An intermediate partition 10 is provided on the blade 3 such that it is raised inward extending from the periphery of the guide post 6 toward the rear mouth 14 of the body 2. The fastener chain 21 using this type of the slider 1 is a flat thin fastener chain 21 having no core thread in which coil-like linear fastener elements 23 are knitted into a side edge of a warp knitted tape 27 composed of warp in-laid structure.

Figure 2:
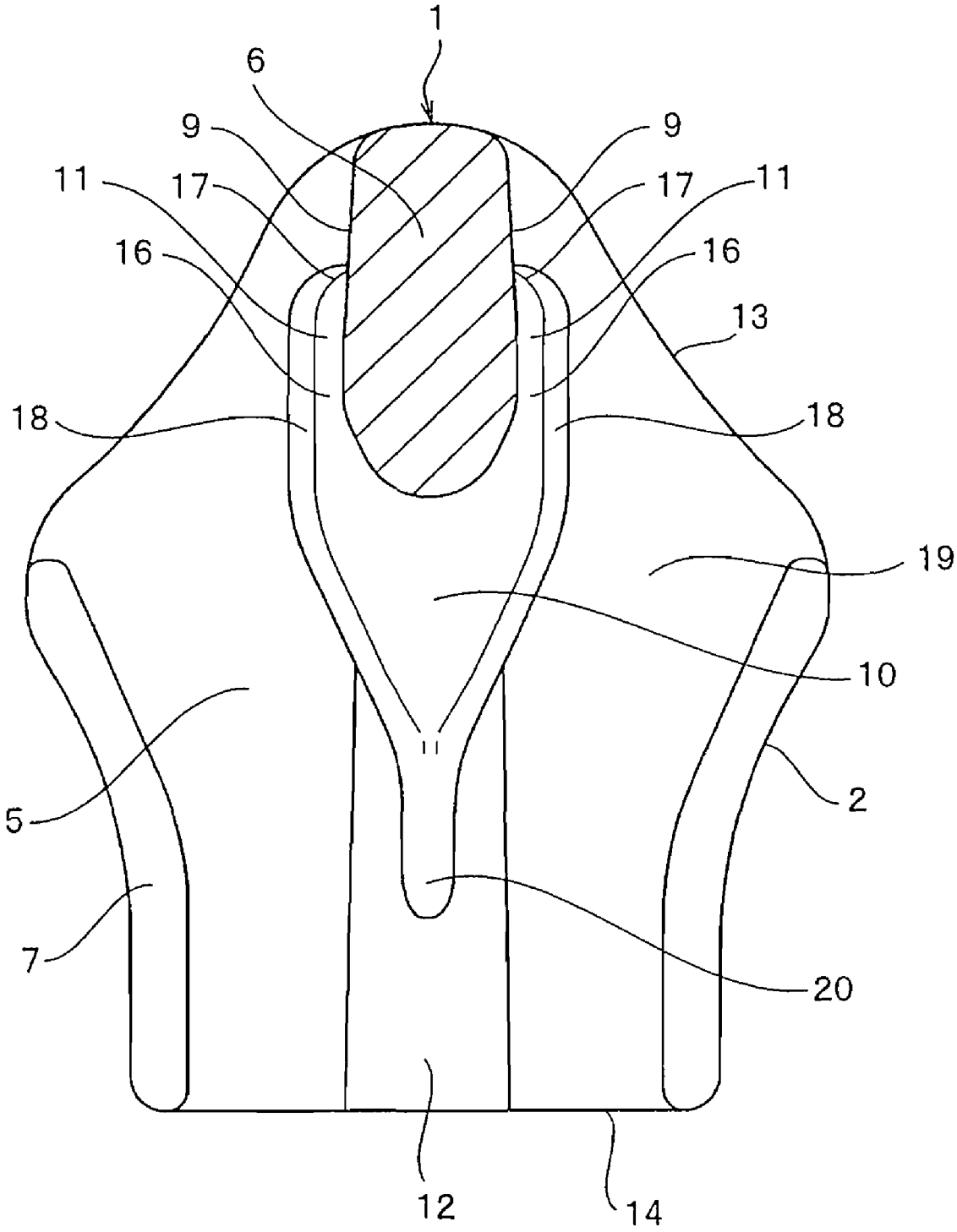
FIG. 2 is a plan view showing an inner surface of a lower blade of the slider.
Figure 3:
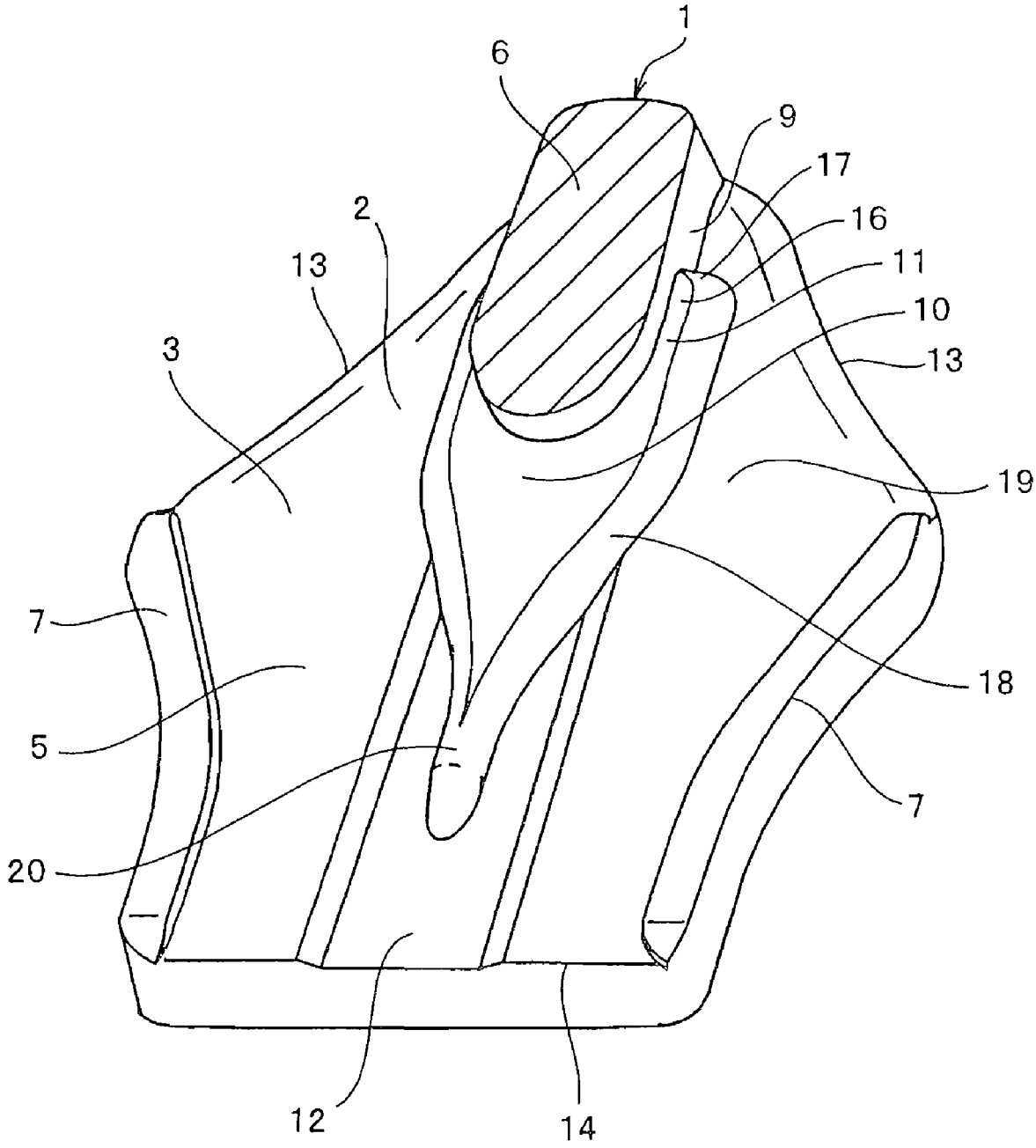
FIG. 3 is a perspective view showing the inner surface of the lower blade of the slider.
Figure 4:
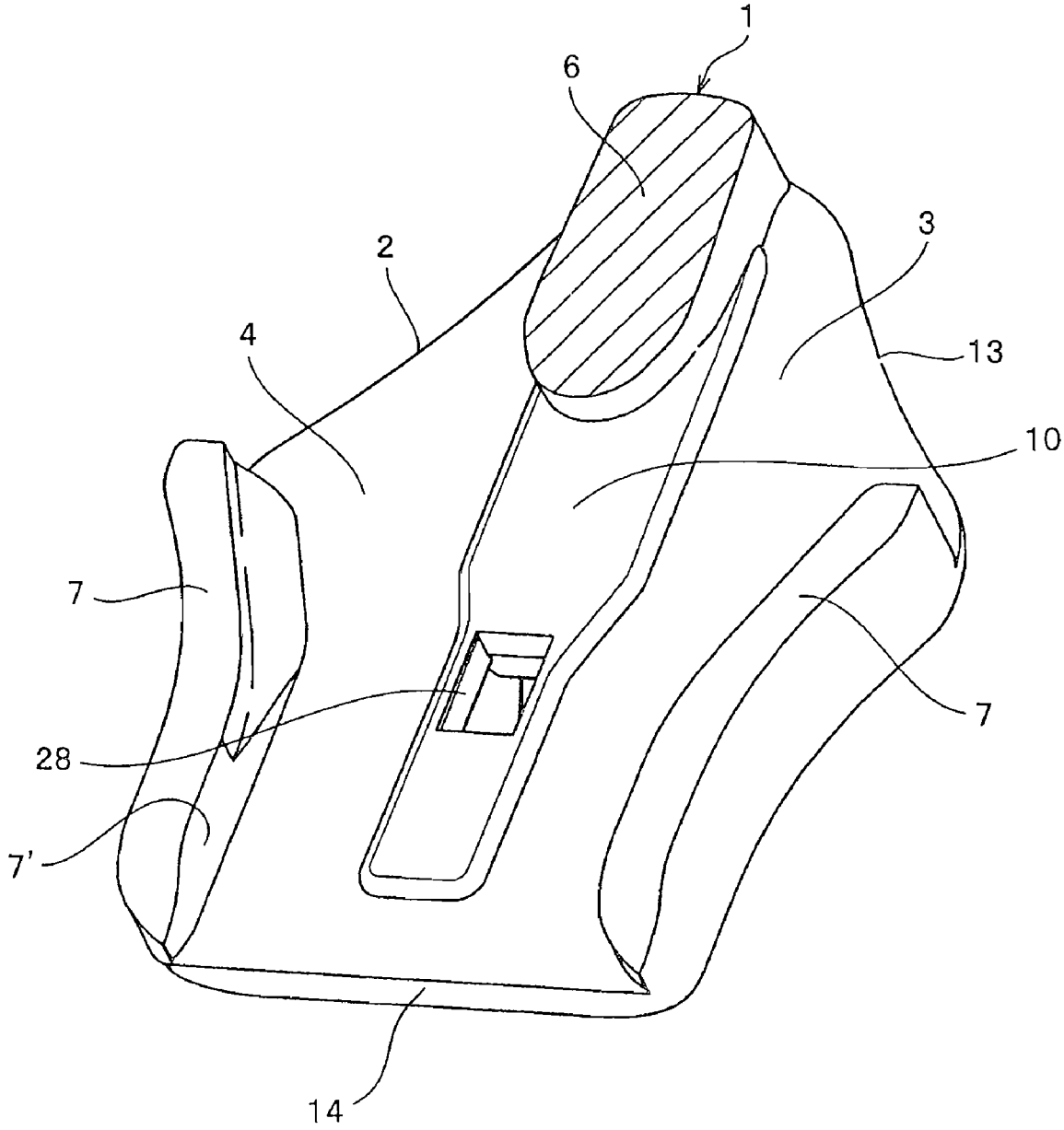
FIG. 4 is a perspective view showing an inner surface of an upper blade of the slider.
Figure 5:
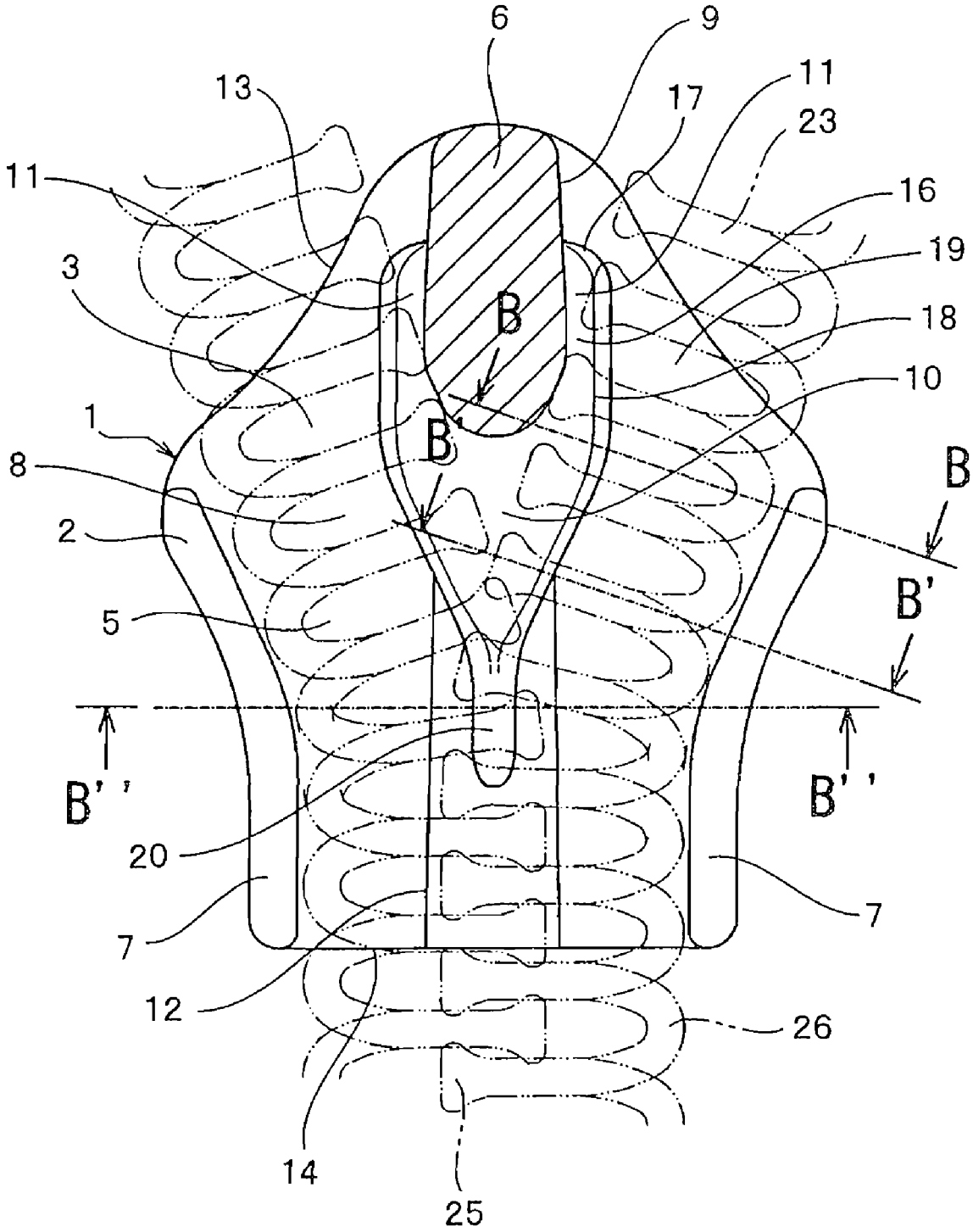
FIG. 5 is a plan view of the slider in which fastener elements are arranged on the lower blade thereof.
Figure 6:
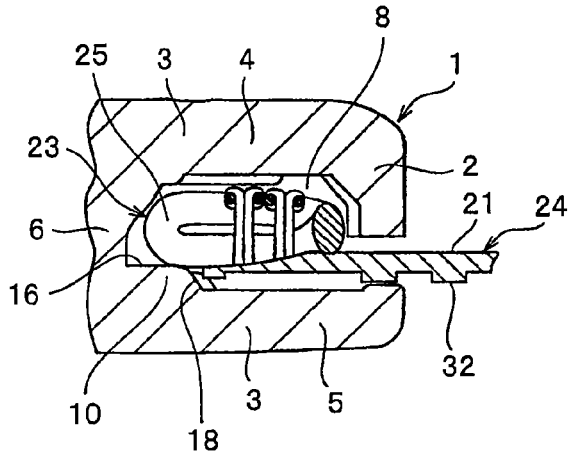
FIG. 6 is a sectional view of the slider taken along the line B-B in FIG. 5.

In a slider 1 of type shown in FIGS. 1 to 10, a very low flange 7 is formed on each of both sides of the lower blade 5 of the blade 3 to be suitable for the fastener chain 21. Then, an intermediate partition 10 is provided on an inner surface 19 of the upper and lower blades 3 such that the intermediate partition 10 is raised inward of the body 2 extending from a proximal portion 9 of the guide post 6 to the rear mouth 14 of the body 2. This intermediate partition 10 is formed on the blade 3 opposing a surface opposite to a surface of the fastener tape 22 to which the fastener elements 23 are attached. As shown in FIGS. 1 and 3, the intermediate partition 10 is formed of a raised portion 11 such that the front ends on the shoulder mouth 13 of the intermediate partition 10 are extended on both side of the guide post 6. Further, a top surface 16 is formed such that a portion thereof on the shoulder mouth 13 is higher with respect to the inner surface 19 of the blade 3 while a portion thereof on the rear mouth 14 side is lower. In addition, the top surface 16 of the raised portion 11 of the intermediate partition 10 on the proximal ends 9 on both sides of the guide post 6 are extended with a fixed width in the same direction as a sliding direction of the slider 1. A surface connecting the top surface 16 with the inner surface 19 of the lower blade 5, namely, a front surface 17 and a side surface 18, are formed of a mild slope. The top surface 16 is so formed that the front end on the shoulder mouth 13 side is the highest and consequently, a coupling head 25 of the fastener element 23 knitted into the fastener tape 22 is placed on the top surface 16 and guided securely as shown in FIG. 6.

Figure 8:
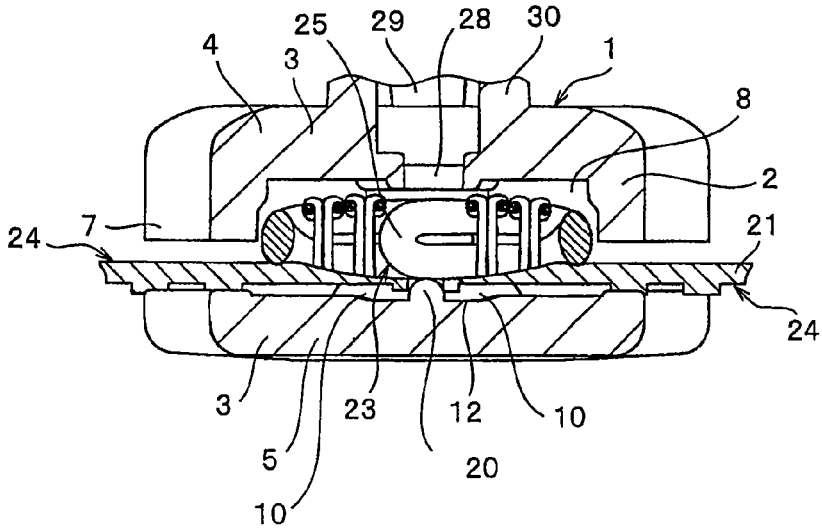
FIG. 8 is a sectional view of the slider taken along the line B"-B" in FIG. 5.

A parallel portion 20 in a long and narrow shape which is raised in a fixed height from the lower blade 5 and extends in the sliding direction, is provided at the front end on the rear mouth 14 side of the intermediate partition 10 formed of a slope. The parallel portion 20 is formed in a fixed height from the inner surface 19 of the lower blade 5. The height of the parallel portion 20 is equal to the height of a lowest portion of the top surface 16 of the intermediate partition 10, and a lowest surface on the rear mouth 14 side of the intermediate partition 10 is continuous to the front end on the shoulder mouth 13 side of the parallel portion 20. The top surface 16 of the intermediate partition 10 is formed such that the width thereof increases gradually as it goes from the connecting portion with the parallel portion 20 toward the raised portion 11. The intermediate partition 10 is formed of a slope such that the height thereof increases gradually from the connecting portion with the parallel portion 20 toward the shoulder mouth 13 side, and a concave groove 12 is provided in the center of the lower blade 5 on the rear mouth 14 side. As shown in FIGS. 5 and 8, the coupling heads 25 in which the fastener elements 23 are coupled comes into contact with the parallel portion 20 when the slider 1 is slid, and the side edges of the right and left fastener tape 22 make contact with the concave groove 12, thereby reducing resistance when the slider 1 is slid.

As shown in FIG. 4, the inner surface of the upper blade 4 of the blade 3 has the flanges 7 projecting higher than the flanges 7 of the lower blade 5 on the edge portions on both sides of the upper blade 4. A gap between the flanges on the upper blade 4 and the lower blade 5 is set to a dimension which allows only the fastener tape 22 to pass therethrough, and a connecting portion 26 at which the fastener element 23 is inverted is guided by an inside wall 7' of the flange 7 of the upper blade 4. The inner surface on the shoulder 13 side of the flange 7 is formed into a slope extending to the inner surface of the upper blade 4 to facilitate introduction of the inverted connecting portion 26 of the fastener element 23 knitted into the fastener tape 22. Further, the intermediate partition 10 is provided in the center of the fastener element along a longitudinal direction from the guide post 6 to the rear mouth 14 side, and a pawl hole 28 for a locking pawl in a locking mechanism for locking the slider 1 is bored in the center of the intermediate partition 10. As shown in FIG. 1, a pull tab attaching portion 30 capable of accommodating a pawl lever 29 having the locking pawl at an end thereof and a pull tab 31 is formed above the pawl hole 28, that is, on the front surface of the upper blade 4.

Figure 7:
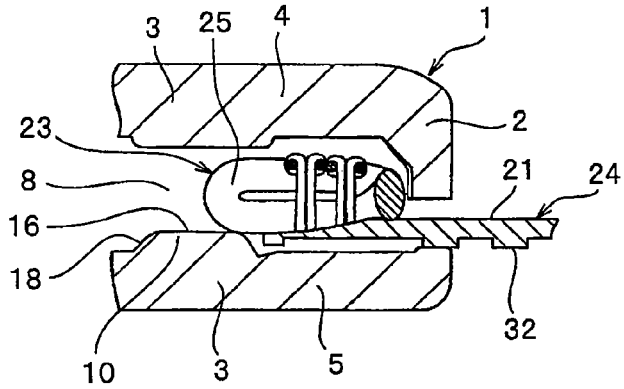
FIG. 7 is a sectional view of the slider taken along the line B'-B' in FIG. 5.

In this slider 1, a indicated with sections taken along lines B-B, B'-B' and B"-B" in FIGS. 6 to 8, the coupling head 25 of the fastener element 23 is placed on the top surface 16 of the intermediate partition 10. As shown in FIG. 7, the coupling head 25 of the fastener element 23 knitted into the fastener tape 22 is placed on the top surface 16 of the intermediate partition 10 located between the guide post 6 and the rear mouth 14. As shown in FIG. 8, the right and left coupling heads 25 of the right and left fastener elements 23 of the fastener chain 21 are placed on the parallel portion 20.

First Embodiment

In a slider for a slide fastener according to a first embodiment shown in FIGS. 1 to 10, a body 2 of a slider 1 is molded by die casting using metal such as aluminum alloy or zinc alloy. In the body 2, an upper blade 4 and a lower blade 5 are combined through a guide post 6, and flanges 7 are provided projectingly on side edges 26 on both sides of the upper blade 4 of the blade 3. A pull tab attaching portion 30 to which a pull tab 31 is attached is provided on the surface of the upper blade 4, and a pawl lever 29 having a locking pawl with automatic locking device is accommodated in the attaching portion 30. The intermediate partition 10 is provided in the center along the longitudinal direction on the inner surface of the upper blade 4 such that the intermediate partition 10 is raised extending from the guide post 6 toward the rear mouth 4 side. A pawl hole 28 in/from which the locking pawl goes/comes is bored in the center of the intermediate partition 10. Of the flange 7 of the upper blade 4 opposing one side edge of the fastener tape 22 to which the fastener elements 23 are attached, of the blade 3, an inside wall 7' of a portion parallel to the sliding direction of the slider 1 is raised at right angle to an inner surface 19 of the upper blade 4.

As shown in FIGS. 2 and 3, the low flanges 7 are provided on both sides of the inner surface 19 of the lower blade 5 opposing a surface opposite to a surface of the fastener tape 22 in the blade 3 to which the fastener elements 23 are attached. The intermediate partition 10 is provided such that it extends from around middle position on both sides of the guide post 6 toward the rear mouth 14 of the body 2 beyond an inside end 15 of the guide post 6 so as to be raised inward. The intermediate partition 10 is formed of the top surface 16 which is inclined such that the shoulder mouth 13 side is the highest while the rear mouth 14 side is the lowest. A raised portion 11 formed on both sides of the guide post 6 is provided such that the top surface 16 has a fixed width along the sliding direction of the slider 1 so as to catch and guide the coupling heads 25 of the fastener element 23. In the meantime, the top surface 16 of the intermediate partition 10 and the inner surface 19 of the lower blade 5 are formed of a mild slope configured of a front surface 17 and a side surface 18 of the raised portion 17. Consequently, the coupling head 25 of the fastener element 23 can ride over the top surface 16 easily, so that the fastener elements are guided smoothly.

The intermediate partition 10 is formed in parallel to the flanges 7 on both sides from the inside end 15 of the guide post 6. The narrow parallel portion 20 whose both sides are parallel are provided on the front end thereof, and the top surface 16 of the parallel portion 20 is raised in a fixed height from the lower blade 5 circularly. Then, a concave groove 12 is provided on both sides of the parallel portion 20 in a stepped configuration. The intermediate partition 10 extending from the intermediate portion on both side surfaces of the guide post 6 to the parallel portion 20 guides the coupling heads 25 of the right and left fastener elements 23 as shown in FIG. 5, so that the coupling heads 25 of the right and left fastener elements 23 can couple each other just in front of the parallel portion 20. The coupling condition is arranged neatly and held by the parallel portion 20 to send the fastener elements to the rear mouth 14. The coupling of the coupling head 25 is supported by the parallel portion 20, and the concave groove 12 receives the side edges of the fastener tape 22 and guides them smoothly.

Figure 9:
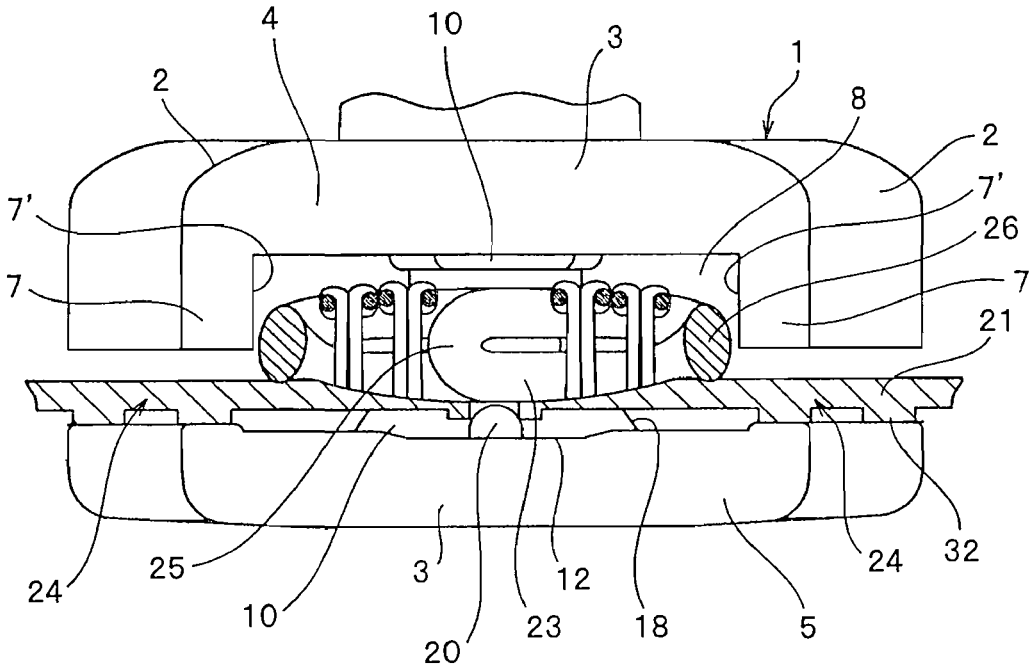
FIG. 9 is an end view of a rear mouth side of the fastener chain in the slider.

The feature of the slider 1 exists in that the intermediate partition 10 provided on the body 2 of the slider 1 is formed of the top surface 16 which is higher on the shoulder mouth 13 side while lower on the parallel portion 20 side as shown in FIG. 1. As for the function of the intermediate partition 10, as shown in FIGS. 5 to 8, the coupling heads 25 of the fastener elements 23 ride over the front surface 17 and the slope of the side surface 18 so that they are placed on the top surface 16 on both sides of the intermediate partition 10 and inserted into the body 2. In the state shown in FIG. 7, the coupling heads 25 are prevented from dropping and being deformed while the sliding performance of the slider is maintained. In the state shown in FIG. 8, the slider 1 is slid so that the coupling heads 25 of the right and left fastener elements 23 can couple normally. As shown in FIG. 9, the fastener elements 23 of the fastener chain 21 are in coupling with each other within the body 2. By providing with the inclined intermediate partition 10, a gap between the top surface 16 and the upper blade 4 opposing the top surface 16 is increased gradually as it goes from the shoulder mouth 13 to the parallel portion 20. As shown in FIG. 6, the position of the coupling head 25 is fixed securely at the front end of the raised portion 11 of the intermediate partition 10 having a relatively small clearance. Thereafter, the fastener elements 23 can be guided along the slope shown in FIG. 7 to a position at which the right and left fastener elements 23 can couple while the positional relationship is maintained. The top surface 16 of the raised portion 11 provided sideway of the guide post 6 does not always to be of flat face but the side surface 18 and the top surface 16 may be formed circularly.

Figure 10:
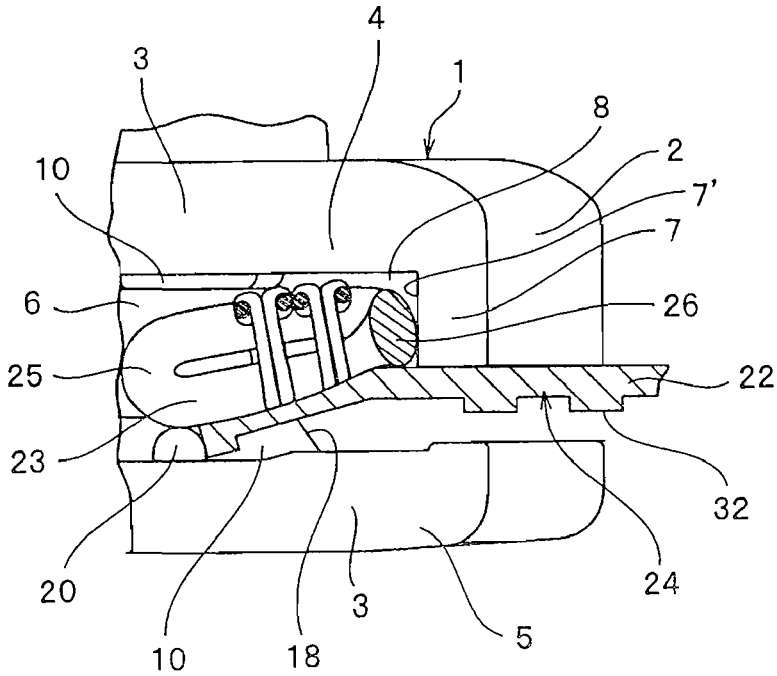
FIG. 10 is an explanatory view showing a state in which a tension in the lateral direction is applied to the fastener chain of the slider.

On the other hand, of the flange 7 formed projectingly along the side edge of the upper blade 4, the inner wall 7' in parallel to the sliding direction of the slider 1 is provided at right angle to the inner surface 19 of the upper blade 4. Under this configuration, as shown in FIG. 10, the connecting portion 26 at which the fastener elements 23 are inverted can be accommodated at a corner portion surrounded by the flange 7 and the inner surface 19 of the upper blade 4 even if a tension is applied to the fastener tape 22 from the right and left, so as to prevent the connecting portion 26 from being pressed against the angle of the flange 7 and damaged.

In the fastener chain 21, the fastener elements 23 are formed by molding mono-filament of polyamide or polyester into a coil or zigzag configuration and the fastener elements 23 are knitted into the side edge of the fastener tape 22 knitted with warp knitting structure. A wale face 32 appearing on one face of the fastener tape 22 is treated as a back side. As a modification, the fastener elements 23 may be woven in with a needle weaving machine. Further, the fastener elements 23 may be sewed onto one side edge using sewing thread, and the present invention may be applied to an ordinary fastener element in which a core thread is disposed inside of the fastener element 23 while the core thread is sewed to the fastener tape 22 with sewing thread.

Second Embodiment

Figure 11:
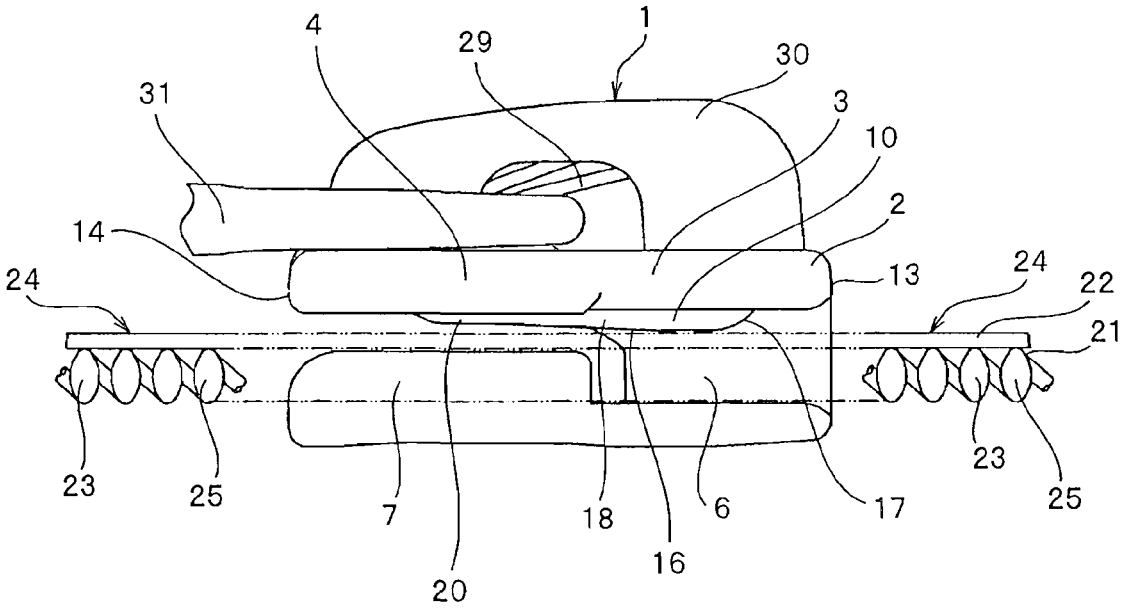
FIG. 11 is a side view of a slider for a slide fastener according to a second embodiment.

A slider for a slide fastener according to a second embodiment shown in FIG. 11 handles a so-called back face using slide fastener in which a fastener tape 22 faces an upper blade 4 side while fastener elements 23 are knitted into the back side. Contrary to the first embodiment, the intermediate partition 10 of the lower blade 5 shown in FIGS. 1 to 10 is formed on the upper blade 4. Speaking in detail, the intermediate partition 10 is formed of a top surface 16 whose shoulder mouth 13 side is high while a rear mouth 14 side is low, from both sides halfway of a guide post 6 toward the rear mouth 14 side. A parallel portion 20 is provided at the front end of the intermediate partition 10 so as to be raised inward in a fixed height. The parallel portion 20 is formed in a narrow configuration while its both sides are parallel and the surface thereof is circular, communicating with the intermediate partition 10. A concave groove 12 as wide as the guiding post 6 is provided on both sides of the parallel portion 20, and a pawl hole 28 for a locking pawl of a locking mechanism is bored in the center of the intermediate partition 10. In a fastener chain 21 for use, a fastener tape 22 is disposed on the front surface and the fastener elements 23 are knitted into the rear surface. The slope formed on the intermediate partition 10 is provided on a blade 3 opposing a surface opposite to a surface of the fastener tape 22 of the fastener chain 21 to which the fastener elements 23 are attached. With this configuration, the same effect as the first embodiment is expected.

Third Embodiment

Figure 12:
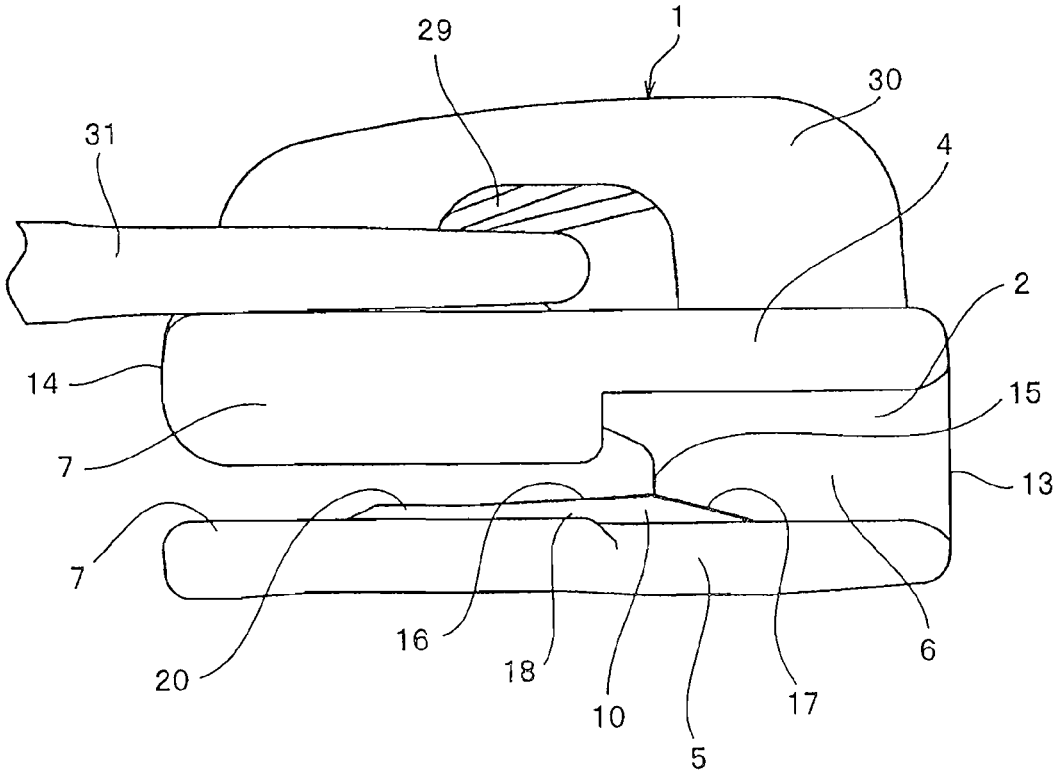
FIG. 12 is a side view of a slider for a slide fastener according to a third embodiment.
Figure 13:
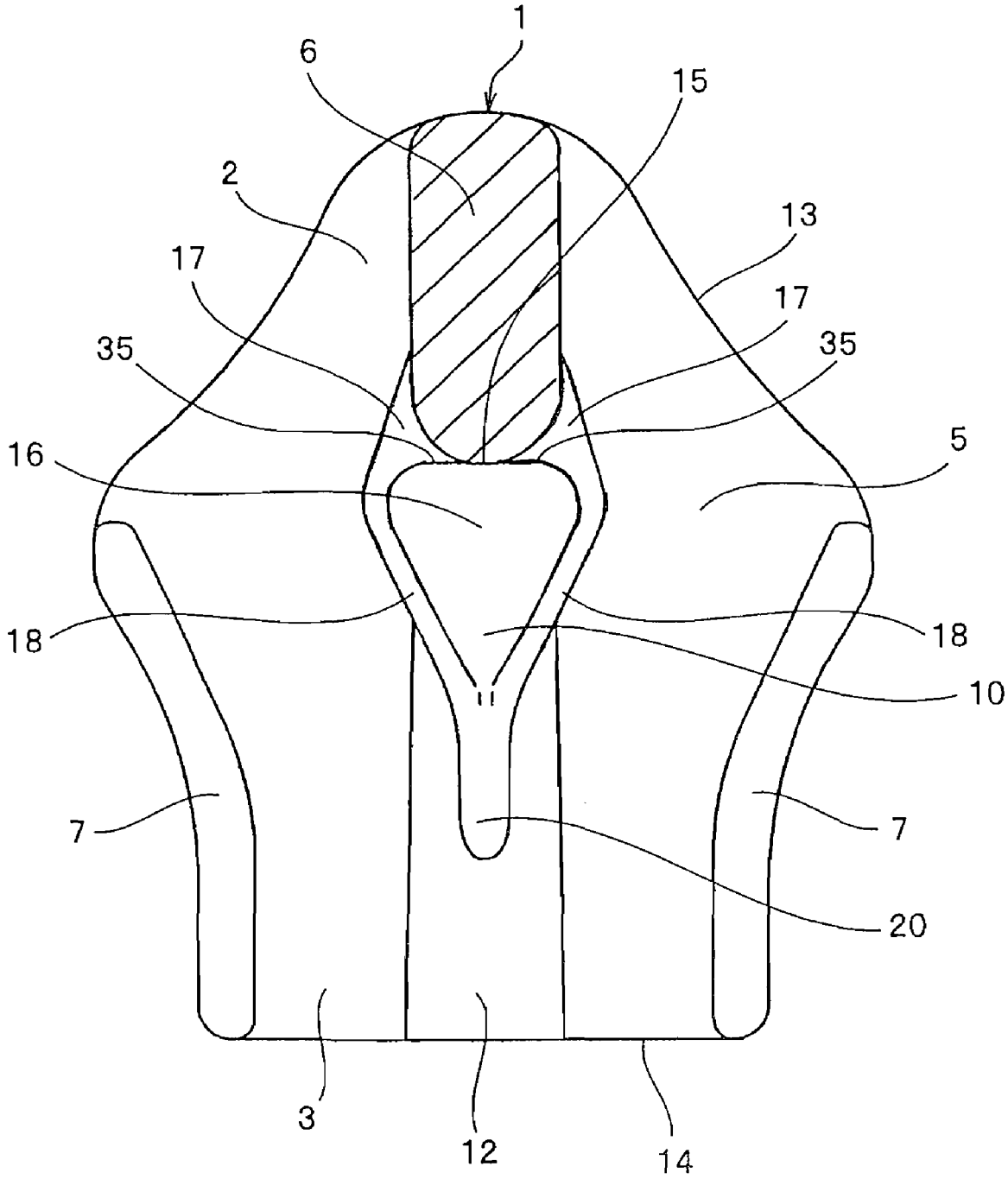
FIG. 13 is a plan view showing an inner surface of a lower blade of the slider.
Figure 14:
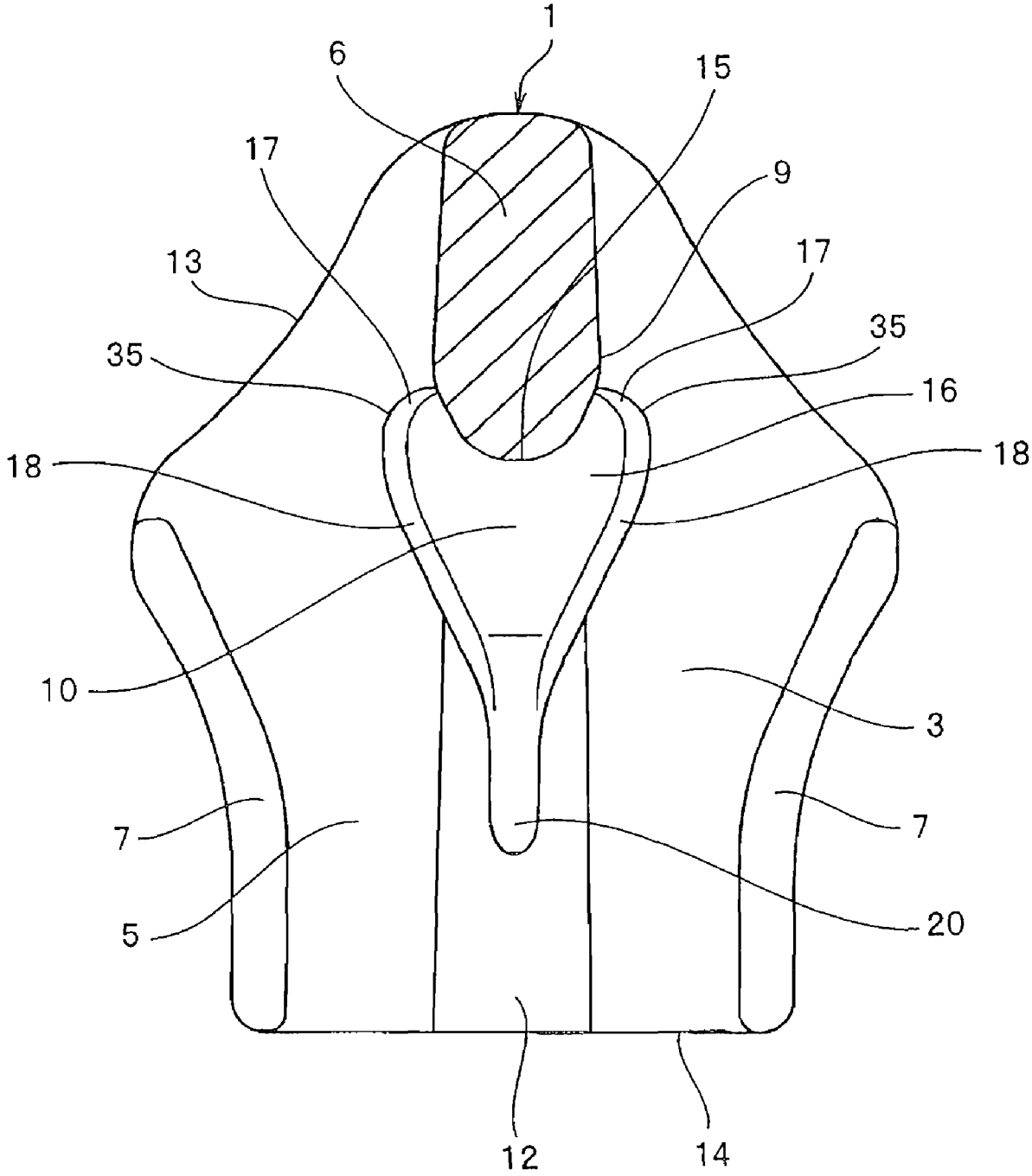
FIG. 14 is a plan view showing the inner surface of the lower blade according to a modification of the slider.

In a slider for a slide fastener according to a third embodiment shown in FIGS. 12 and 13, an upper blade 4 and a lower blade 5 are connected through a guide post 6 to constitute a body 2 of a slider 1. An intermediate partition 10 is provided on the lower blade 5 such that it extends from an inside end 15 of the guide post 6 toward a rear mouth 14. The intermediate partition 10 is formed of the top surface 16 which is inclined such that a shoulder mouth 13 side is high while the rear mouth 14 side is low. The width of the inside end 15 of the intermediate partition 10 is wider than the width of the guide post 6, so that coupling heads 25 of fastener elements 23 are placed and guided thereby. A parallel portion 20 having parallel both sides is provided at the front end of the intermediate partition 10, so as to exert the same function as the first embodiment. As a modification, as shown in FIG. 14, a beginning portion of the intermediate partition 10 may be moved to the shoulder mouth 13 side of the guide post 6 with respect to the inside end 15 of the guide post 6.

Fourth Embodiment

Figure 15:
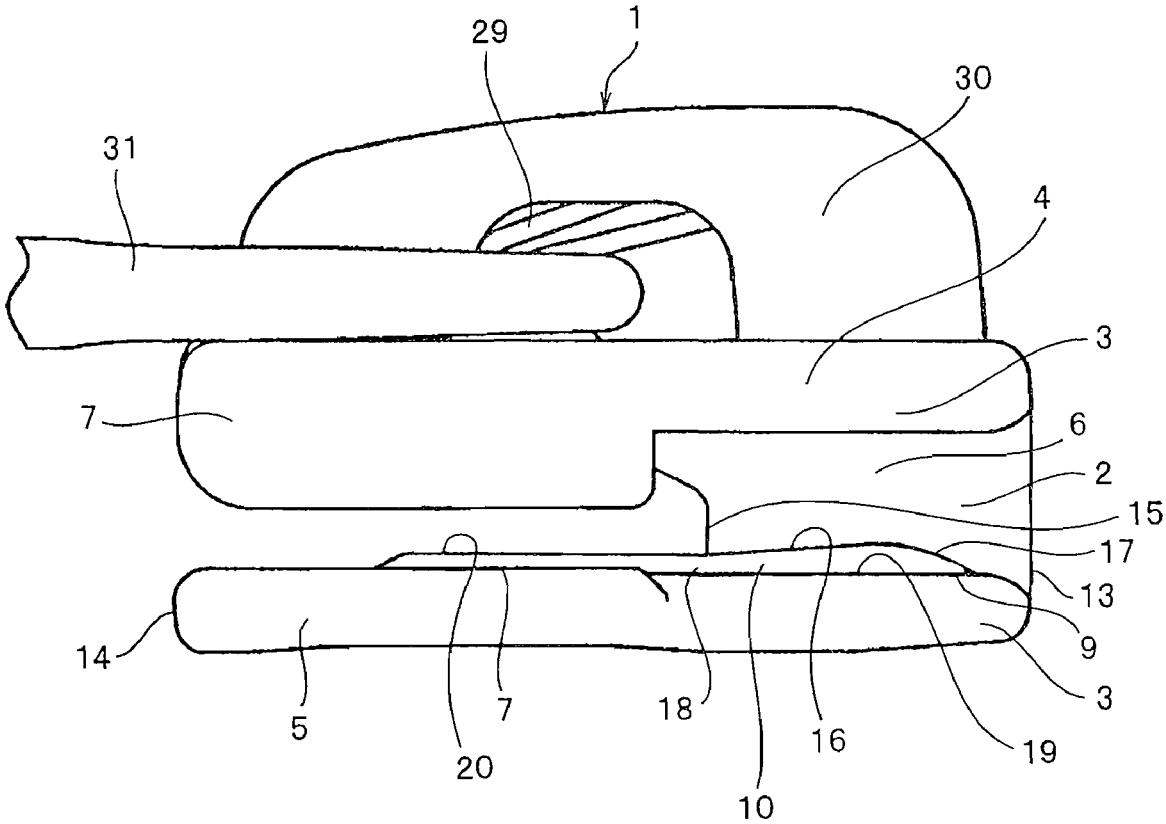
FIG. 15 is a side view of a slider for a slide fastener according to a fourth embodiment.
Figure 16:
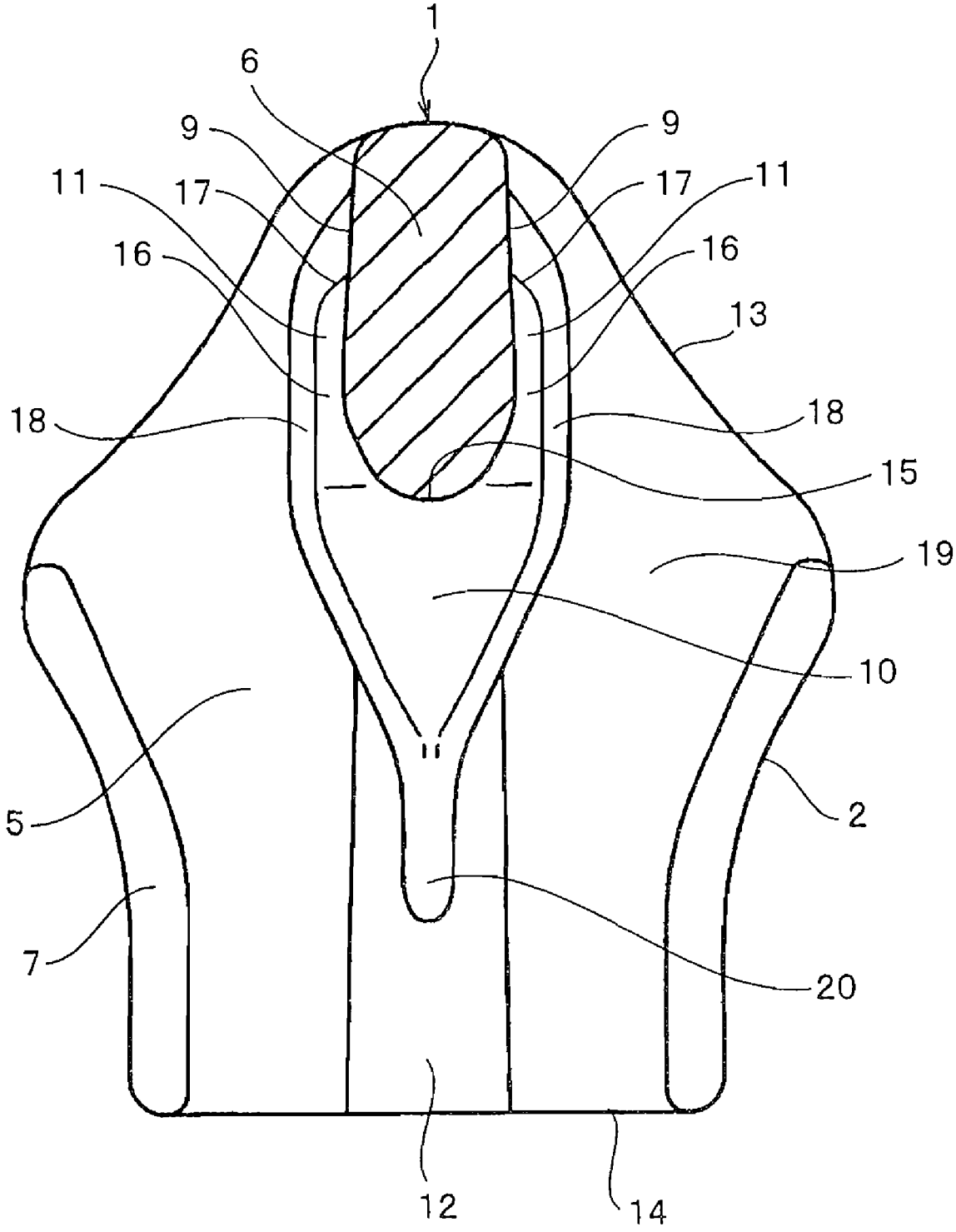
FIG. 16 is a plan view showing an inner surface of a lower blade of the slider.
Figure 17:
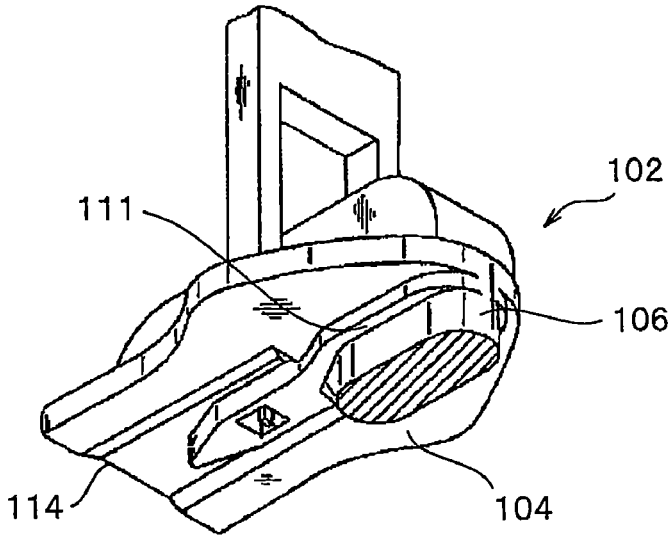
FIG. 17 PRIOR ART
FIG. 17 is a perspective view showing an inner surface of an upper blade of a known slider.
Figure 18:
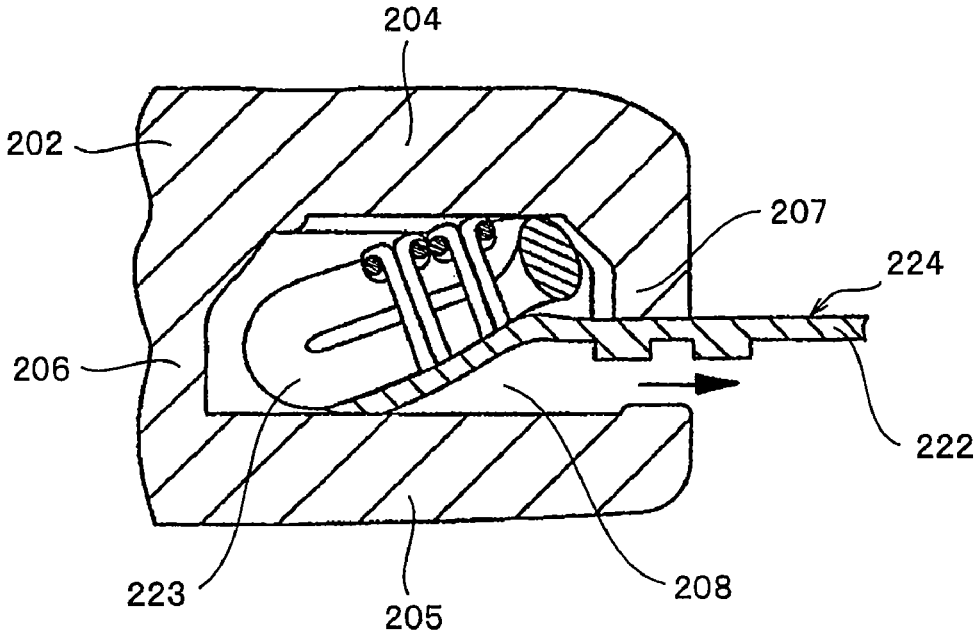
FIG. 18 PRIOR ART
FIG. 18 is a sectional view of another known slider in which a tension in the lateral direction is applied.

In a slider for a slide fastener according to a fourth embodiment shown in FIGS. 15 and 16, an upper blade 4 and a lower blade 5 are connected through a guide post 6 to constitute a body 2 of a slider 1. An intermediate partition 10 is provided on an inner surface 19 of the lower blade 5 such that it is raised in the same height as a parallel portion 20 extending from an inside end 15 of the guide post 6 toward a rear mouth 14. The planar shape of the intermediate partition 10 is the same as the slider 1 of the first embodiment. An edge portion or a side surface 18 of the intermediate partition 10 is formed in parallel to the inner side of the low flange 7 located outside and connected to the intermediate partition 10 composed of a raised portion 11 formed on both sides of the guide post 6 extending from the front end of the intermediate partition 10, that is, the guide post 6 side. The intermediate partition 10 provided on both sides of the guide post 6 is formed to entirely present a slope configuration in which a top surface 16 is high on a shoulder mouth 13 side while a portion contacting the inside end 15 of the guide post 6 is low. The intermediate partition 10 at the inside end 15 of the guide post 6 is connected to the intermediate partition 10 having the same height as the parallel portion 20 through a flat configuration.

When right and left fastener stringers 24 of the slider 1 are inserted from the shoulder mouth 13 of the body 2, the coupling heads 25 of the fastener elements 23 are introduced to and placed on the intermediate partition 10 on both sides of the guide post 6 such that the coupling heads 25 project from the side edge of the fastener tape 22 or the fastener elements 23 are prevented from being inclined with respect to the fastener tape 22. Connecting portions 26 of the right and left fastener elements 23 are pressed inward by the higher flanges 7 provided on both sides of the upper blade 4 on the intermediate partition 10 between the guide post 6 and the rear mouth 14, so that the right and left coupling heads 25 are coupled with each other on the intermediate partition 10 between the guide post 6 and the parallel portion 20. The fastener chain 21 in coupling is discharged out of the body 2 from the rear mouth 14 of the body 2. When the fastener chain 21 in coupling is inserted from the rear mouth 14 of the body 2, the coupling heads 25 of the fastener elements 23 in coupling are separated to right and left by the inside end 15 of the guide post 6 when the slider is slid. Thus, the respective fastener elements 23 are introduced to the intermediate partition 10 disposed on both sides of the guide post 6, so that the fastener elements are discharged out of the body 2 through the shoulder mouth 13, thereby achieving the opening/closing operation of the fastener chain 21.

The slider for a slide fastener of the present invention is used by being attached to a product in which the appearance or function of a fastener is regarded as important, for example, clothes or bags. The slider allows smooth sliding operation and coupling operation so as to reduce sliding resistance.

What is claimed is:

1. A slider of a slide fastener in which a pair of blades are connected with a guide post and which includes a guide groove which allows a fastener chain to pass therethrough is provided between the blades, an intermediate partition is provided on an inner surface of one of the blades in a body of the slider so that the intermediate partition projects towards the other one of the blades, wherein a parallel portion whose both sides are parallel and formed in a narrow width is extended from a front end of the intermediate partition on a side of a rear mouth, and the parallel portion is formed with a fixed height with respect to the one of the blades, and the intermediate partition is formed so that an amount of projection on a side of a shoulder mouth is larger than that on the side of the rear mouth while a top surface of the intermediate partition is formed into a slope which rises as it goes from a connecting portion connecting with the parallel portion toward the side of the shoulder mouth.

2. The slider of a slide fastener according to claim 1, wherein the slider is constituted of an upper blade having a pull tab attaching portion and a lower blade located at a position opposing the upper blade and connected through the guide post, and the top surface in a slope shape formed on the intermediate partition is formed on one of the blades opposing a surface opposite to a surface of a fastener tape in a fastener chain to which fastener elements are attached.

3. The slider of a slide fastener according to claim 1, wherein the intermediate partition formed on both sides of the guide post is formed of a raised portion in a narrow width, and the raised portion is disposed in a same direction as a sliding direction of the slider.

4. The slider of a slide fastener according to claim 1, wherein the intermediate partition provided on the sides of the guide post has a top surface having a fixed width, and the top surface is connected to the inner surface of one of the blades through a slope.

5. The slider of a slide fastener according to claim 1, wherein the intermediate partition is provided so that a width thereof is increased as it goes from the parallel portion toward the raised portion.

6. A slider of a slide fastener in which a pair of blades are connected with a guide post and a guide groove of a fastener chain provided between the blades is included, an intermediate partition is provided on an inner surface of one of the blades in a body of the slider so that the intermediate partition projects towards the other one of the blades, wherein the intermediate partition is formed so that an amount of projection on a side of a shoulder mouth is larger than that on a side of a rear mouth while a top surface of the intermediate partition is formed into a slope which rises as it goes toward the side of the shoulder mouth, wherein a position of a shoulder mouth side edge portion of the slope is in contact with a rear mouth side edge portion of the guide post.

7. A slider of a slide fastener in which a pair of blades are connected with a guide post and a guide groove of a fastener chain provided between the blades is included, an intermediate partition is provided on an inner surface of one of the blades in a body of the slider so that the intermediate partition projects towards the other one of the blades, wherein the intermediate partition is formed from the middle of the body toward proximal portions on both sides of the guide post while a top surface of the intermediate partition is formed into a slope which rises as it goes toward the side of the shoulder mouth wherein the slope is formed continuously up to a top surface of the raised portion of the both sides of the guide post.

* * * * *

UNITED STATES PATENT AND TRADEMARK OFFICE

CERTIFICATE OF CORRECTION

PATENT NO. : 8,056,194 B2
APPLICATION NO. : 12/168319
DATED : November 15, 2011
INVENTOR(S) : Yohei Miyazaki et al.

It is certified that error appears in the above-identified patent and that said Letters Patent is hereby corrected as shown below:

On the Cover Page, item (75), in Inventors, in column 1, line 1, delete "Yohel" and insert -- Yohei --, therefor.

In column 4, line 31, delete "goes form" and insert -- goes from --, therefor.

In column 7, line 62, delete "a indicated" and insert -- as indicated --, therefor.

In column 12, line 45, in Claim 7, delete "portion of" and insert -- portion on --, therefor.

Signed and Sealed this
Third Day of January, 2012

David J. Kappos

David J. Kappos
*Director of the United States Patent and Trademark Office*